US005356138A

United States Patent [19]

Chen et al.

[11] Patent Number: 5,356,138

[45] Date of Patent: Oct. 18, 1994

[54] DUAL WEIGHT GOLF CLUB SET

[75] Inventors: Ming T. Chen, Salt Lake City; Jeffrey R. Thurman, West Valley City, both of Utah

[73] Assignee: Pro Sports, U.S.A., Salt Lake City, Utah

[21] Appl. No.: 126,607

[22] Filed: Sep. 27, 1993

[51] Int. Cl.[5] ..... A63B 53/04

[52] U.S. Cl. ..... 273/77 A; 273/167 F; 273/169

[58] Field of Search ..... 273/77 A, 167 F, 169, 273/171

[56] References Cited

U.S. PATENT DOCUMENTS

| | | | |
|---|---|---|---|
| D. 267,965 | 2/1983 | Kobayashi | D21/220 |
| D. 268,775 | 4/1983 | Pace | D21/220 |
| D. 269,101 | 5/1983 | Reymann, Jr. et al. | D21/220 |
| D. 276,644 | 12/1984 | Solheim | D21/220 |
| 956,594 | 5/1910 | Myles | 273/167 F |
| 2,087,685 | 7/1937 | Hackney | 273/167 F |
| 3,059,926 | 10/1962 | Johnstone | 273/77 A |
| 3,250,536 | 5/1966 | Moser | 273/167 F |
| 3,655,188 | 4/1972 | Solheim | 273/77 A |
| 3,751,035 | 8/1973 | Lockwood | 273/77 A |
| 3,814,437 | 6/1974 | Winquist | 273/167 F X |
| 3,845,960 | 11/1974 | Thompson | 273/167 F X |
| 4,147,349 | 4/1979 | Jeghers | 273/77 A |
| 4,322,083 | 3/1982 | Imai | 273/167 F |
| 4,326,326 | 4/1982 | MacDonald | 273/167 F X |
| 4,420,156 | 12/1983 | Campau | 273/77 A |
| 4,512,577 | 4/1985 | Solheim | 273/77 A |
| 4,621,813 | 11/1986 | Solheim | 273/77 A |
| 4,715,601 | 12/1987 | Lamanna | 273/77 A |
| 4,848,747 | 7/1989 | Fujimura et al. | 273/77 A |
| 4,907,806 | 3/1990 | Antonious | 273/167 F X |
| 5,026,056 | 6/1991 | McNally et al. | 273/77 A |
| 5,048,835 | 9/1991 | Gorman | 273/167 F |
| 5,056,788 | 10/1991 | Katayama | 273/77 A |
| 5,160,136 | 11/1992 | Eger | 273/167 F X |
| 5,193,805 | 3/1993 | Solheim | 273/77 A |
| 5,209,473 | 5/1993 | Fisher | 273/167 F X |

*Primary Examiner*—William H. Grieb
*Attorney, Agent, or Firm*—Marcus G. Theodore

[57] ABSTRACT

An improved dual weight correlated set of iron-type golf clubs, each club having a neck to attach to a shaft, and a face for impacting a golf ball, a back surface, a heel portion, a toe portion, and a sole, wherein the improvement comprises: reinforcement periphery balancing weight structure placed along the perimeter of the back of the club defining a cavitated back, the balancing weight structure having least weight and thickness starting at the top of the back of the club and gradually increasing in weight and thickness toward the sole of the club along the perimeter of the toe, sole, and heel to provide better balance and strength behind the periphery of the hitting surface of the face of the club, and a second mound weight reinforcing structure partially filling the cavitated back of the iron-type club behind the hitting surface of the club, with a curvilinear base reinforcing the sole of the club and a mound mass curvilinearly rising from low points proximate the toe and heel along the sole and gradually rising to a peak, filling the middle of the back of the cavity of the club behind the lower segment of the hitting surface of the club face to add center weight behind the segment of hitting surface of the club face wherein a ball leaves impacts and leaves the hitting surface.

5 Claims, 2 Drawing Sheets

DUAL WEIGHT GOLF CLUB SET

BACKGROUND OF THE INVENTION

1. Field

This invention relates to golf clubs, and more particularly to golf club irons, having a dual counterweight which improves the performance of miss hits on the club face and also reinforces the club face for center hits.

2. State of the Art

A large number of different golf club iron sets are known. These correlated sets of golf clubs have club striking faces with increasing angles of attack to loft a ball a desired distance. The club heads are also increasingly weighted, and the shafts are decreasingly shortened to maintain consistent swing momentum so that each club swing, if properly hit, increases the distance the golf ball travels by approximately 10 yards. For example, in a correlated set, each club head weight generally increases approximately 7 grains per increase in club number. However, each shaft length incrementally decreases about ½ inch for a steel shaft per increase in club number (If lighter weight shafts made of graphite, or similar materials are employed, each shaft will be lengthened approximately ½" so that the shaft has approximately the same weight as a steel shaft). Shaft types and lengths vary depending upon the swing of a golfer. For example, the majority of golfers fall into the average swing category, and have a 65 to 85 mph swing requiring a shaft with a low flex point and a 4.0 torque rating. Conversely, professional golfers having a 100 to 115 mph swing require a shaft with a mid flex point with a 2.0 torque rating.

The angle of the club face also increases per increase in the club number to add loft to the flight of the golf ball. The weighted center of gravity of the club also moves up per increase in club number. A typical set has the following specifications:

| | SPECIFICATIONS | | | | | | | | |
|---|---|---|---|---|---|---|---|---|---|
| Club | 1 | 2 | 3 | 4 | 5 | 6 | 7 | 8 | 9 |
| Loft | 16° | 18° | 21° | 24° | 28° | 32° | 36° | 40° | 44° |
| Lie* | 56° | 57° | 58° | 59° | 60° | 61° | 62° | 63° | 64° |
| Weight** | 223 | 240 | 247 | 254 | 261 | 268 | 275 | 282 | 289 |

*Lie = plus or minus 0.5 degrees
**Weight = plus 2 gr. or minus 2 gr.

A few golf club irons are designed to enable a golfer to off center hit the ball on the club face and maintain shot alignment. Thompson, U.S. Pat. No. 3,845,960, and Imai, U.S. Pat. No. 4,322,083, are examples of sole reinforced iron clubs which add mass along the sole of the club to optimize distance. Although distance is increase, heel or toe off center hit shots do not maintain shot alignment. Nor do shots hit on the upper unreinforced face of the club maintain distance.

For those golfers who consistently hit their shots along the toe of the club, a number of toe weighted clubs have been designed: Lamanna, U.S. Pat. No. 4,715,601, Solheim, U.S. Pat. No. 3,655,188, and Campau, U.S. Pat. No. 4,420,156.

Solheim, U.S. Pat. No. 4,621,813, discloses a correlated set of golf clubs with back cavities, the heads of which each contain (1) a sole including a trailing edge which is indented toward the striking face a distance of at least 1/16 of an inch, and (2) a lower back surface adjacent the indented trailing edge sloping upwardly and inwardly from the indented trailing edge toward the striking face. This configuration allows the club head material which would otherwise be located in the indented areas to be redistributed in the heel and toe portions of the club heads. The redistributed head materials increase the mass concentrations in the heel and toe areas which improves the resistance to twisting of the club heads upon off-center heel and toe impacts with the golf ball. Another example of a back cavity club with heel and toe reinforcement is Lockwood, U.S. Pat. No. 3,751,035. The center cavity club designs maintain alignment, but do not allow an off center hit shot to maintain consistent distance. Nor do center hit shots achieve optimum distance as the center face of the club does not have sufficient mass behind it.

McNally et al., U.S. Pat. No. 5,026,056, discloses another heel-toe balancing club. McNally et al. discloses a correlated set of golf clubs of the iron type in which each club head has a cavity formed in the back surface thereof with specially configured weight pads formed integrally within the back cavity. The weight pads are so configured and positioned within the confines of the back cavity as to create desired heel-toe balancing of each club head wherein each club head's center of gravity is physically centered, both horizontally and vertically of the club head, behind the visually-perceived optimal striking point, i.e., the apparent visual center of percussion of the club's striking face relative to the golf ball at address. This configuration is designed to provide better club balance, and minimize misdirection of heel or toe off center hit shots. Other examples of heel-toe balancing clubs are: Reymann, Jr. et al., U.S. Pat. No. Des. 269,101, and Solheim, U.S. Pat. No. Des. 276,644.

These cavity backed clubs do not provide a solid mass behind the club face center to maximize hitting distances. To overcome this lack of center of mass, the Merit Fusion/Nicklaus N1 provides a set of correlated golf clubs with an iron weight bar placed within the inside of the back cavity which can be adjusted vertically to promote vertical balancing for an exact center of gravity as well as provide additional mass behind the club face. MacDonald, U.S. Pat. No. 4,326,326 is another example of a lead insert golf club head positioned directly behind the center of the intended striking surface to improve distance. Other examples of center reinforced golf club heads are: Winquist, U.S. Pat. No. 3,814,437, Kobayashi, U.S. Pat. No. Des. 267,965, and Pace, U.S. Pat. No. Des. 268,775. Unfortunately, these center reinforced cavity configurations also raise the center of gravity of the club face, thereby reducing the mass along the lower center of the club face proximate the sole where maximum leverage striking force for an iron shot is delivered. Indeed, the Pace design actually raises the center of gravity.

Other patents of interest are: Solheim, U.S. Pat. No. 4,512,577, discloses a set of correlated golf clubs, the heads of which are provided with a narrowed neck connecting the main body of the club head to the hosel. The midsection of the neck has a cross section of maximum dimension less than the diameter of the hosel so that, when the main body of the club head twists under impact with a ball, the narrowed neck will function as a torsion bar with twisting tension occurring in the midsection. In that manner, the twisting motion of the main body is uncoupled from the hosel and shaft to provide a more forgiving shock absorbing club head in the event an iron shot is miss hit. This shock absorbing feature does not give consistent distance to a miss hit ball.

Moser, U.S. Pat. No. 3,250,536, is an example of a sand wedge with a reinforced weighted club having a different density filling material filling a cavity in the back of the club to balance the club.

There thus remains a need for a rear cavity weighted club which maintains a low center of gravity while providing additional mass behind the center of the striking surface of the club to optimize shot distance and alignment even though the shot is off center hit near the toe, heel, or upper segment of the club face. The golf club set described below provides such an invention.

SUMMARY OF THE INVENTION

The present invention comprises an improved dual weight correlated set of iron-type golf clubs. Each club is made of 431 cast steel or similar material, and has a neck to attach to a shaft, preferably made of graphite. The club has an angled face for impacting a golf ball, a back surface, a heel portion, a toe portion, and a sole. Attached to the back of the club is a reinforcement periphery balancing weight structure placed along the perimeter. This reinforcement periphery balancing weight structure defines a cavitated back of the club, and provides increasing weight and thickness behind the toe and heel of the club. The mass behind the heel and toe has least weight and thickness at the top of the club and gradually increases in thickness toward the sole of the club. This weight distribution not only provides better balance and strength behind the periphery of the hitting surface of the face of the club, but lowers the center of gravity of the club to provide most of the mass along the sole of the club to maximize hitting distance. It also provides mass behind the heel and toe of the face to maintain shot alignment for off center shots hit in the toe and heel regions of the club face.

Mounted within the back cavity of the club is a second mound weight reinforcing structure partially filling the lower segment of the back cavity of the iron behind the hitting surface of the club wherein approximately 85% of shots after being struck leave the hitting surface. The mound weight rises curvilinearly from the base to add center weight behind the lower segment of hitting surface of the club face from low points proximate the reinforced toe and heel reaching a peak covering the center segment of the back of the cavity of the club behind the center hitting surface of the club face. The curvature of the mound thus provides added center mass behind 85% of the shots hit proximate the center of each iron face as reflected by a Gaussian distribution. Thus, the height of the mound weight increases with as the number of each club increases. This is because the increasing club head has a greater angled hitting surface, which allows struck balls to leave the hitting surface farther up on the club face. To insure that these shots have sufficient mass behind them to add distance to the higher iron shots, the weighted mound extends higher behind the hitting surface with higher irons.

The mound weight has a curvilinear base providing most of the mass along the sole of the club to optimize hitting distance. The curvilinear thickness is least thick along the back of the sole proximate the heel and toe segments and gradually increases to a maximum thickness proximate and behind the center segment of the sole of the club face.

This second mound weight thus adds club mass behind most of the lower hitting surface of the club face to add distance to miss hit shots. The dual weighted club therefore not only aligns off center hit heel and toe shots via the reinforced heel and toe segments, but adds distance to these shots, thereby providing a more forgiving club for novice and professional golfers.

It was found empirically through testing a dual weight number five iron that off center hits $\frac{3}{4}$ inch near the toe were within 1 yard of center hits, and off center hits $\frac{3}{4}$ inch near the heel were within 2 yards of center hits. The improved club head thus maintains consistent shot alignment and distance with hits along the face of the club.

To insure aerodynamic club travel, the mound centerweight surface is aerodynamically smoothed to minimize wind resistance during the swing. The back of the cavity may also define a groove along the top of the curvilinear mound centerweight to distribute some of the cavity weight.

To aid in balancing the club, the periphery balancing weight structure along the back of the toe has a first rounded depression proximate the middle of the toe segment which leads into the back cavity. It also has a second rounded depression proximate the middle of the sole leading into the back cavity; thereby more evenly distributing the mass along the heel, toe, and sole of the club. This more evenly distributed additional mass aids club balance, and adds momentum and distance to a shot.

The invention thus provides an improved dual weight golf club set which not only maintains shot alignment for off center heel and toe iron shots, but maintains consistent distance.

DESCRIPTION OF THE ILLUSTRATED EMBODIMENTS

Figure 1:
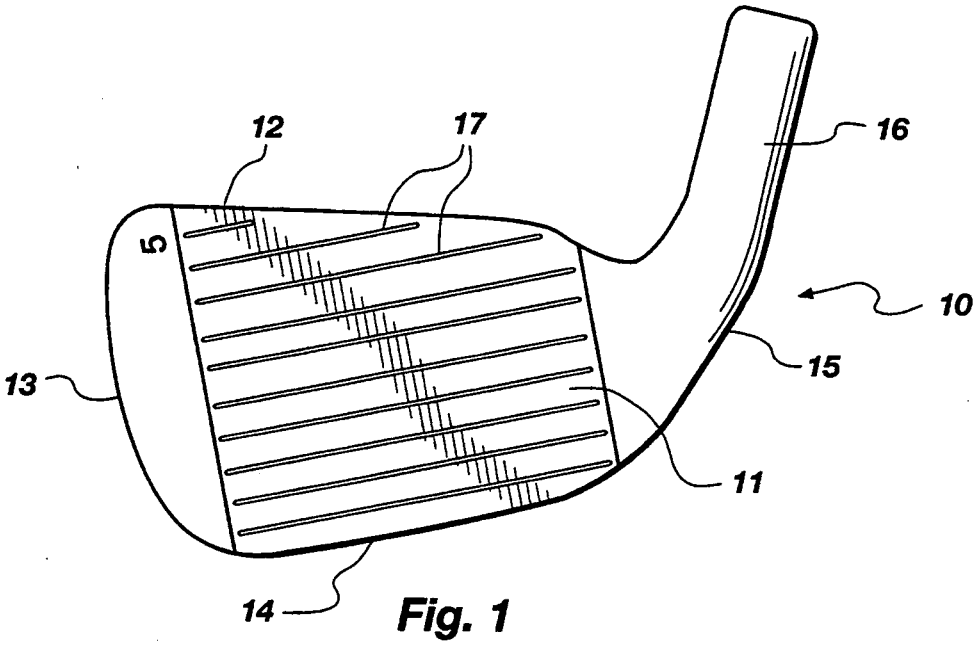
FIG. 1 illustrates a side perspective view of one preferred embodiment of the invention.

FIG. 1 illustrates a perspective view of the front of the club head 10. The face 11 of the club head 10 has a top edge 12, a toe region 13, a sole region 14, and a heel region 15 associated with a hosel 16 to accommodate a shaft (not shown). The face 11 may contain grooves 17 to impart friction to the ball on impact where reverse spin in desired. In some embodiments (not shown), face inserts made of graphite or similar smooth materials may be employed with the lower numbered irons where spin is not desired to enable the ball to roll farther.

Figure 2:
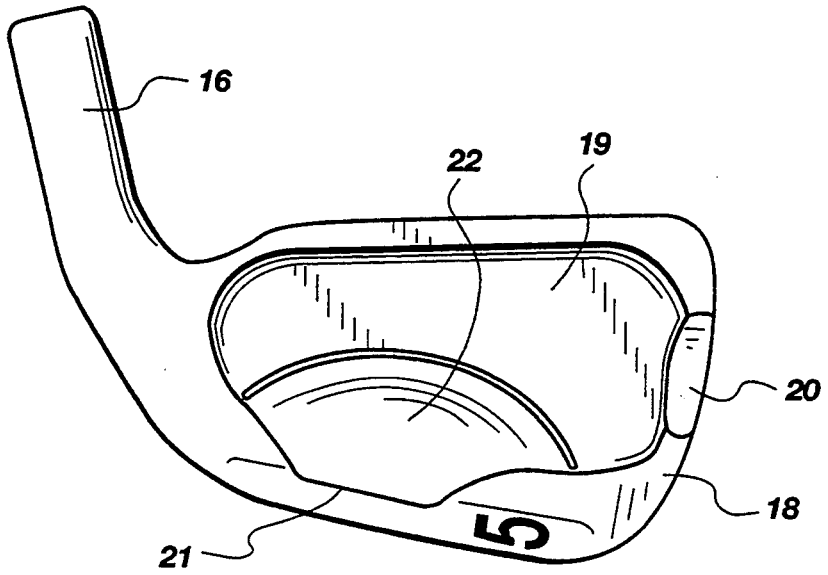
FIG. 2 illustrates a back perspective view of the embodiment of the invention shown in FIG. 1.

FIG. 2 is a rear perspective of the back of the club head 10 shown in FIG. 1. The perimeter of the toe region 13, sole region 14, and heel region 15 is reinforced with weighted balancing structure 18 forming a cavity 19 in the back of the club head 10. To better distribute the weight of the club head 10, the toe region 13 and the sole region 14 have rounded depressions 20 and 21. This material is then transferred to the toe and heel regions 13, 15 proximate the sole 14 to add weight and lower the center of gravity of the club head 10. Positioned within the cavity 19 is a mound weight 22 partially filling the lower segment of the back cavity 19 behind the hitting surface 11 of the club 10 wherein approximately 85% of shots leave the face 11 hitting surface after being struck. The mound weight 22 rises curvilinearly from the base to add center weight behind the lower segment of hitting surface of the club face from low points proximate the reinforced toe and heel segments 13, 15. It reaches a peak covering the center segment of the back of the cavity 19 of the club 10 behind the center hitting surface of the club face 11. The curvature of the mound weight 22 thus provides added center mass behind 85% of the shots hit proximate the center of each iron's face 11.

Figure 3:
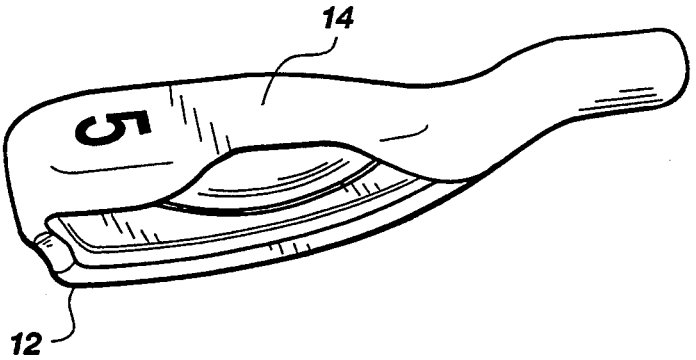
FIG. 3 illustrates a top view of the embodiment of the invention shown in FIG. 1.

In FIG. 3, the top of the club head 10 shows how the top edge 12 is thinner than the sole segments 14 to provide a low center of gravity, and optimal mass along the sole segments 14 to optimize shot distance.

Figure 4:
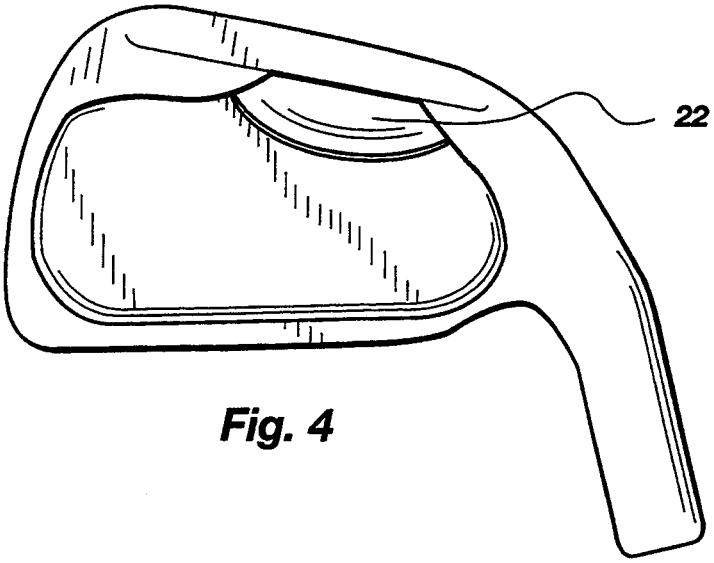
FIG. 4 illustrates a back view of a number 2 iron.
Figure 5:
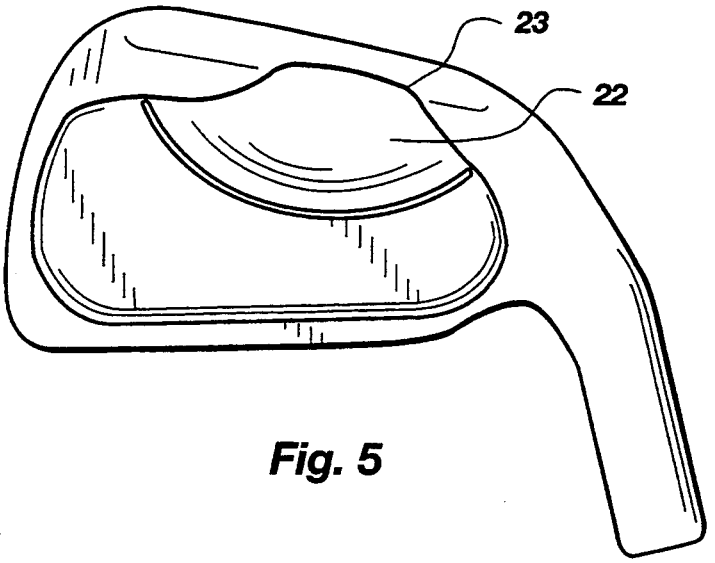
FIG. 5. illustrates a back view of a number 5 iron.
Figure 6:
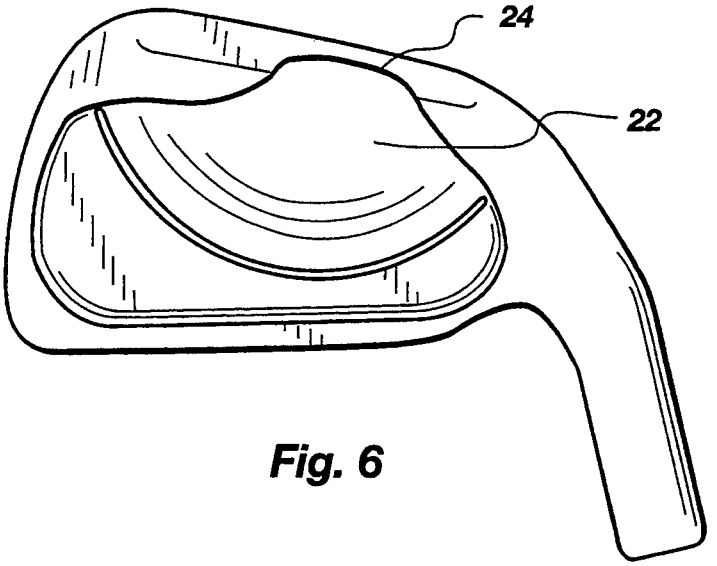
FIG. 6 illustrates a back view of a number 9 iron.

As shown in FIGS. 4, 5, and 6, the height of the mound weight 22 increases with as the number of each club increases. FIG. 4 shows the weight distribution of a number 2 iron, with least mass and height in the mound weight 22. FIG. 5 shows the weight distribution of a number 5 iron, with more mass and height in the mound weight. FIG. 6 shows the weight distribution of a number 9 iron, with optimum mass and height in the mound weight 22. This is because the increasing club bead has a greater angled hitting surface, which allows struck balls to leave the hitting surface farther up on the club face 11. To insure that these shots have sufficient mass behind them to add distance to the higher iron shots, the mound weight 22 is structured to extend higher and place more weight behind the hitting surface with higher irons.

The mound weight 22 has a curvilinear base 23 providing most of the mass along the sole segment 14 of the club 10 to optimize hitting distance. The curvilinear thickness of the mound weight 22 is least thick along the back of the sole segment 14 proximate the heel and toe segments 13, 15, and gradually increases to a maximum thickness proximate and behind the center segment 24 of the sole of the club face 11.

Although this specification has made reference to the illustrated embodiments, it is not intended to restrict the scope of the appended claims. The claims themselves recite those features deemed essential to the invention.

We claim:

1. An improved dual weight correlated set of iron-type golf clubs, each club having a neck to attach to a shaft, and a face for impacting a golf ball, a back surface, a heel portion, a toe portion, and a sole, wherein the improvement comprises:

a. reinforcement periphery balancing weight structure placed along the perimeter of the back of the club defining a cavitated back, said balancing weight structure having least weight and thickness starting at the top of the back of the club and gradually increasing in weight and thickness toward the sole of the club along the perimeter of the toe, sole, and heel to provide better balance and strength behind the periphery of the hitting surface of the face of the club, and including b. a second mound weight reinforcing structure partially filling the cavitated back of the iron-type club behind the hitting surface of the club, with i. a curvilinear base reinforcing the sole of the club with gradually increasing curvilinear thickness starting with least thickness along the back of the sole proximate the heel and gradually increasing to a maximum thickness proximate and behind center of the sole of the club face, and then gradually decreasing in thickness along the sole behind the center of the sole of the club face to the toe; and ii. a mound mass curvilinearly rising from a low point proximate the heel along the sole to a peak filling the middle of the back of the cavity of the club behind the lower segment of the hitting surface of the club face, and thereafter curvilinearly declining to a low point proximate the back of the toe along the sole to add center weight behind the segment of hitting surface of the club face wherein a ball leaves impact and leaves said hitting surface.

2. A dual weight correlated set of iron-type golf clubs according to claim 1, wherein the back of the cavity defines a groove along the top of the curvilinear mound centerweight.

3. A dual weight correlated set of iron-type golf clubs according to claim 1, wherein the periphery balancing weight structure along the back of the toe defines a first rounded depression leading into the back cavity, and a second rounded depression proximate the middle of the sole leading into the back cavity.

4. A dual weight correlated set of iron-type golf clubs according to claim 1, wherein the second mound centerweight reinforcing structure has an aerodynamically smooth surface along the back of the club to minimize wind resistance.

5. A dual weight correlated set of iron-type golf clubs according to claim 1, including face inserts of various frictional type materials affixed to the hitting surface of the face of the club.

* * * * *